United States Patent [19]

Beer

[11] 4,392,686

[45] Jul. 12, 1983

[54] ADJUSTABLE OFFICE CHAIR

[75] Inventor: Herbert Beer, Wendelstein, Fed. Rep. of Germany

[73] Assignee: Steifensand Sitzmobel- und Tischfabrik, Inh., Fed. Rep. of Germany

[21] Appl. No.: 243,951

[22] PCT Filed: Jul. 4, 1980

[86] PCT No.: PCT/EP80/00042

§ 371 Date: Mar. 4, 1981

§ 102(e) Date: Mar. 4, 1981

[87] PCT Pub. No.: WO81/00044

PCT Pub. Date: Jan. 22, 1981

[30] Foreign Application Priority Data

Jul. 6, 1979 [DE] Fed. Rep. of Germany ..... 2927377

[51] Int. Cl.[3] ..... A47C 1/027

[52] U.S. Cl. ..... 297/376; 16/337

[58] Field of Search ..... 297/374, 376, 328; 16/337–339, 341; 74/531

[56] References Cited

U.S. PATENT DOCUMENTS

| | | | |
|---|---|---|---|
| 1,597,847 | 8/1926 | Walton . | |
| 4,018,104 | 4/1977 | Bland et al. | 74/531 |
| 4,198,094 | 4/1980 | Bjerknes | 297/328 |

FOREIGN PATENT DOCUMENTS

| | | | |
|---|---|---|---|
| 1902670 | 10/1970 | Fed. Rep. of Germany . | |
| 7144228 | 3/1972 | Fed. Rep. of Germany . | |
| 7239551 | 9/1973 | Fed. Rep. of Germany . | |
| 7428281 | 11/1974 | Fed. Rep. of Germany . | |
| 2335586 | 1/1975 | Fed. Rep. of Germany . | |
| 2836606 | 3/1979 | Fed. Rep. of Germany . | |
| 2338015 | 8/1977 | France . | |
| 260823 | 8/1949 | Sweden . | |
| 581856 | 10/1946 | United Kingdom | 297/374 |

*Primary Examiner*—William E. Lyddane

*Attorney, Agent, or Firm*—Bacon & Thomas

[57] ABSTRACT

The present invention discloses an adjustable office chair in which the backrest may be adjusted in relation to the seat carrier. This adjustment is realized by means of an actuating lever and a clamping bolt arrangement which allows a linkage system to vary the position of the backrest in relationship to the seat. Once a desired relationship between the two parts is realized, the actuating lever is released and the linkage system is locked into a fixed position. This arrangement is realized by providing a spring system which displaces a clamp bolt in its longitudinal direction relative to the parts to be immobilized. The actuating lever, when activated, acts on a thrust bearing of the clamp bolt and displaces the clamp bolt into the release position.

7 Claims, 3 Drawing Figures

ADJUSTABLE OFFICE CHAIR

Figure 1:
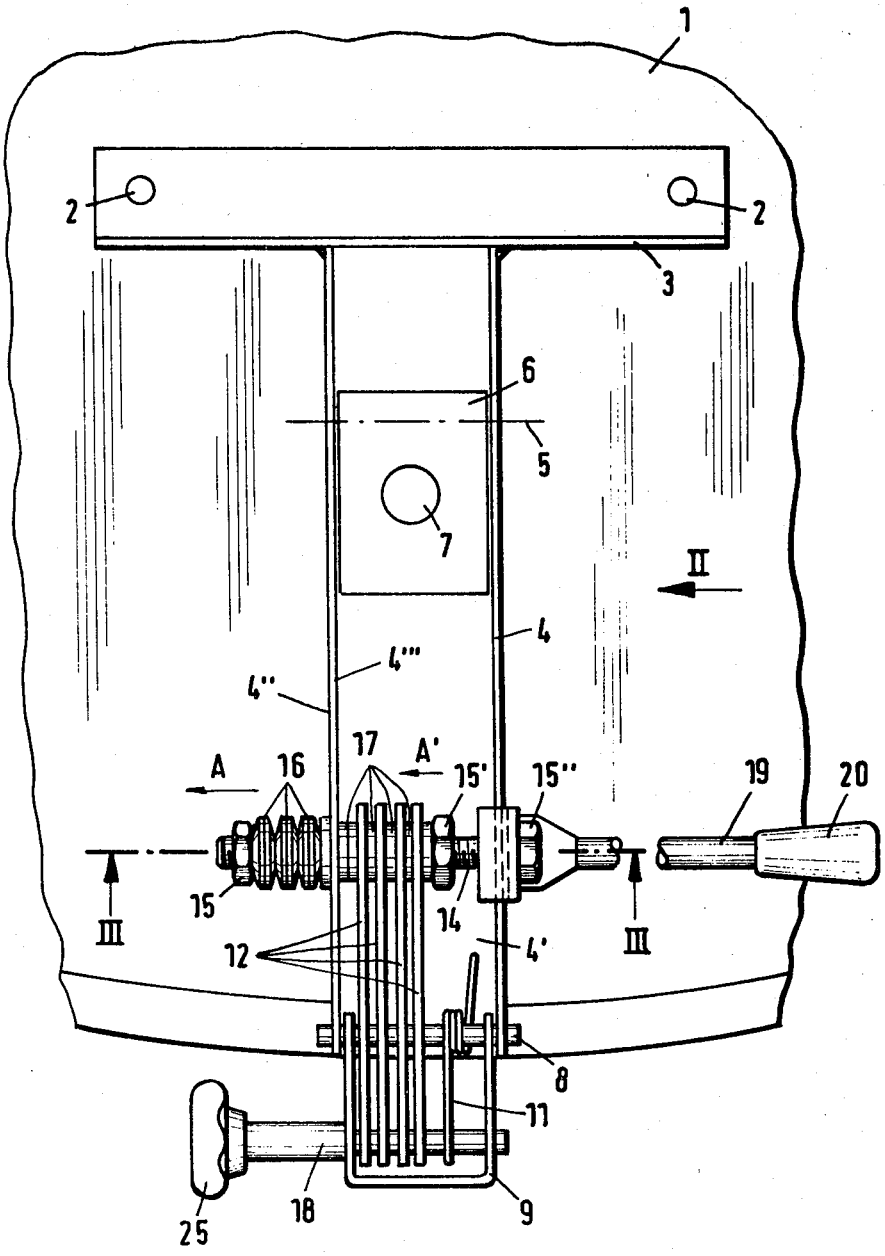

The invention concerns a unit of seating furniture according to the preamble of claim 1. Such a seating convenience is known from DE-OS No. 23 35 586. Therein the support of the seat and the back rest are adjustable independently of the instantaneous position of the other part in different positions in relation to the supporting structure, said adjustment being continuous. The clamping of the butt straps to the base frame is effected by means of the clamping bolt and the lever in a manner wherein eccentric disks mounted on the lever act to press or clamp the butt straps and the support structure together. The above cited reference further shows a similar arrangement, wherein the clamping or pressing function is effected by means of two cam disks of the clamping bolt. The disadvantage therein consists of the fact that the actuating surfaces of the eccentric or cam disks become worn in the course of time and for this reason or as the result of inaccurate manufacturing processes, do not occupy their exact intended position. This may lead to the consequence that the force exerted by the eccentric or cam disks is no longer sufficient to obtain the pressing effect desired.

A similar chair is known from DE-AS No. 19 02 670. Therein butt straps of this type are locked together by means of a manual lever, which is pressured into the clamping or locking position by a spring stressedly mounted between a lever arm associated with it and the back rest.

A chair similar to the above described type is further known from DE-GM No. 7 239 551. Therein, plates or straps of the seat carrier are passed through a plurality of plates of the support structure. By means of a screw that may be rotated by means of a manual handle, the two sets of plates or straps are clamped together to secure the position of the chair attained. The set of plates of the support structure is further connected with the back rest. The seat and the back rest may thereby be adjusted in any angular position with respect to the support structure and secured in such a position. A disadvantage, however, is the handling of the adjusting and immobilizing mechanism by the operator. The latter is required to reach with one hand under the chair to grip the handle of the screw and rotate the latter until there is no longer a frictional connection between the said plates or straps. Subsequently, the adjustment desired must be effected and then the screw handle must again be rotated to immobilize the setting, until the necessary clamping force is attained. The operator therefore must perform in addition to the adjusting process itself two further functions (unscrewing and lock-screwing), each of which requires a certain amount of time. Furthermore, it is difficult for a person seated on the chair to perform such a screwing adjustment, blind, as it were.

It is the object of the invention to improve a seating convenience according to the preamble of claim 1 so that a structurally simple arrangement is provided, while avoiding the above described eccentric clamping and its disadvantages, which assures even in the case of potentially occurring dimensional inaccuracies of the parts involved, a secure fastening of the parts of the chair in the position desired.

The object of the invention is attained by the characteristics of claim 1. Even when the parts involved are worn or are inaccurate in their dimensions, this can easily be bridged by the path of displacement of the clamping bolt that is relatively long with respect to said inaccuracies and by the corresponding expansion of the spring, so that even in such cases a satisfactory clamping or blocking of the parts is obtained. In spite of this, the swivel path of the lever for the locking of the parts may be relatively short. A slight touching is sufficient.

The invention is applicable both to the adjustment of the back rest in relation to the seat carrier and to the adjustment of the seat carrier with respect to the support structure, wherein preferably both of the above mentioned adjustment of a chair are suitably provided. However, only one of these adjustments may be provided in a given chair also.

Figure 2:
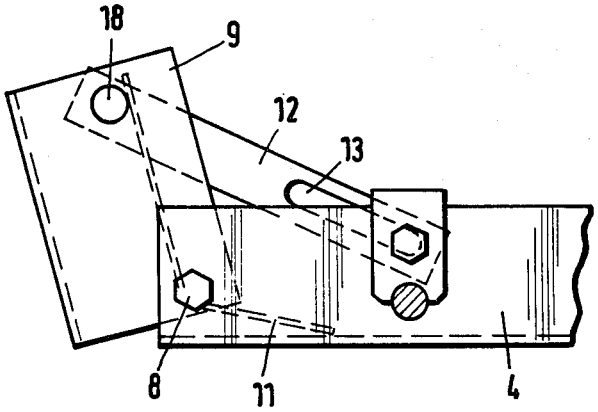
Figure 3:
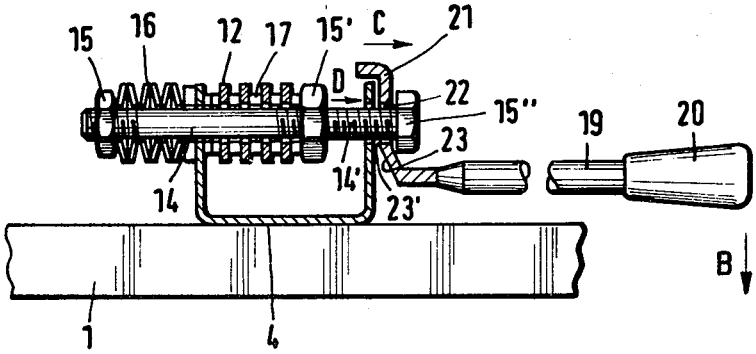

Further advantages and characteristics of the invention may be found in the dependent claims and in the examples of embodiment of the invention described hereinbelow and in part shown in the drawing. In the drawing:

FIG. 1 shows a bottom view of the seating surface of the swivelling office chair with a part of the support structure, the seat carrier and the back rest, FIG. 2 a view according to the arrow II in FIG. 1, and FIG. 3 a cross section on the line III—III in FIG. 1.

A seat carrier is fastened to the seating surface 1 of a swivelling office chair by means of a plurality of screws, of which only the screws 2 are visible; with said seat carrier consisting of an angle 3 and a channel shape 4. The channel shape 4 is hingedly connected with a tube section 6 by means of an axle or shaft 5, which is indicated only, said tube section serving as a support structure and carrying in its opening 7 the support cone of the foot stand (not shown). By means of a further axle 8, a holder 9 of the back rest is swivellingly connected with the channel section 4 of the seat carrier. An adjusting helical spring II is wound around the axle 8, said spring being supported on the one hand on the bottom 4' of the channel section and on the other, by the holder 9 of the back rest, while it tends to pressure the part carrying the back rest cushion and insertable in the back rest holder, to be secured therein by means of the threaded handle 25, against the back of the person seated on the chair.

In the present example of embodiment, the invention is explained by means of the adjustment of the back rest and its holder 9, respectively, in relation to the seat carrier, specifically to its U-shaped channel section. For this purpose, one or a plurality of plates or straps 12 (designated hereinafter only as plates) are provided, each of said plates gripping with a slit 13 (FIG. 2) a clamp bolt 14. On one end of the clamp bolt 14, specifically at its end located in FIG. 1 outside the channel section 4, a first thrust bearing, for example a screw nut 15, is mounted fixedly. Further, a plurality of plate springs 16 (a helical spring may be provided in their place) are installed, said plate springs being supported between the outer side 4'' of the channel section 4 and the first thrust bearing 15 and tending to pressure said thrust bearing and thus the clamp bolt 14 in the direction of the arrow A. A second thrust bearing 15' is fixedly mounted on the axle 14 between the two legs of the U-shaped channel section 4, on the side opposite to the support surface 4''' of the channel 4 of the plates 12, for example in the form of a screw nut on a thread 14' of the clamp bolt 14, said thrust bearing also being pressured by the force of the springs 16 in the direction of the arrow A and A', respectively. The second thrust bearing 15′ thereby is pressuring the plates 12 and the washers 17 against the inner wall 4‴ of the channel section. This frictional lock is sufficient to hold the plates securily against the channel section 4. As the plates are hinged, on the other hand, to the back rest holder 9 by means of a pin 18, the angular position of the back rest in relation to the seat carrier is thereby secured. The clamp bolt 14 may be displaced with respect to the channel section 4 and the plates 12, and the washers 17.

The lever arrangement, which is actuatingly connected with the spring arrangement and upon its actuation by the operator absorbs the spring pressure generating the frictional lock, is designed in the present example of embodiment as follows:

A manual handle 20 is mounted on a long lever arm 19, extending approximately parallel to and underneath of the seating surface. The lever arm 19 continues in a bearing surface 23. This is connected with a shorter lever arm 21, wherein the arms 19, 21 are approximately at right angles to each other. A bore 22 of the shorter lever arm 21 is penetrated by the clamp bolt 14, which is displaceable in said bore also (FIG. 3). A third thrust bearing is fixedly mounted on the end to the right in FIGS. 1 and 3, i.e. located outside the channel section, of the clamp bolt 14, for example in the form of a screw nut 15″ screwed onto the thread 14′. The mode of operation is as follows:

When the lever 20 is slightly depressed in the direction of the arrow B, it pivots around the point or edge 23′, until the support surface 23 abuts against the adjacent leg of the channel section 4. The lever arm 21 is pivoted in the direction of the arrow C and thereby displaces by means of the third thrust bearing 15″ the clamp bolt 14 with the thrust bearings 15 and 15′ in the direction of the arrow D, i.e. in its longitudinal direction, whereby the springs 16 are slightly compressed. This releases the frictional lock between the parts 12, 17 and 4‴ and the holder 9 of the back rest may be swivelled toward the channel section 4 of the seat carrier. If the back rest is to be pivoted farther back, this may be effected by a suitable pressure of the back of the person seated on the chair. If, on the other hand, the back rest is to be pivoted forward, it is only required of the operator to move his back forward—after the lever 19, 20 has been depressed—whereby the adjusting spring 11 effects the corresponding pivoting motion of the back rest holder 9 and thus of the back rest. When the swivelling or setting position is attained, the operator releases the lever arm 19, 20 and the springs 16 automatically return the clamp bolt 14 in its longitudinal direction with the thrust bearings 15, 15′, 15″ in the above described clamped position resulting in frictional locking. This immobilization is automatic. The operator must perform only a single manipulation, namely the depression of the lever arm 19, 20.

The lever arm 21 extending to the pivoting point 23′ of the lever is relatively small compared with the other lever arm 19. As the result of this lever translation provided by the invention, the force to be applied by the operator to release the frictional lock is relatively slight. The effect is enhanced further by that the edge 23′ is located in the immediate vicinity of the side of the clamp bolt 14 facing the support surface 23. Furthermore, it is necessary to swivel the lever arm 19 with its handle 20 by a relatively small angle only.

The shorter lever arm 21 grips with a bend 24 the upper edge of the adjacent leg of the channel section 4. This serves to prevent an accidental rotation of the lever arrangement around the clamp bolt 14.

The axle 18 may carry a screw handle 25, whereby the legs of the back rest holder 9 may be pressed against each other and the back rest that is adjustable in height immobilized in its position with respect to height.

As mentioned hereinabove, a fundamentally similar arrangement for the adjustment of the angular position of the seat carrier 3, 4 with respect to the support structure 6 and for the release and immobilization of the adjusted position may be provided. Here again, an adjusting spring according to 11, may be provided. For reasons of simplicity, the above mentioned arrangement is not shown in the drawing.

I claim:

1. Seating furniture, in particular an adjustable office chair, with a support structure fixedly attached to a foot stand, a seat carrier and a back rest, wherein at least the inclination of two of the aforementioned parts is variable with respect to each other and may be immobilized in the position desired by means of plates, separated by intermediate shims, and locked by friction, wherein the frictional lock is established with the aid of a clamp bolt and the plates are equipped each with an elongated hole surrounding the clamp bolt, wherein further a relative displacement occurs between the plates and the intermediate shims on the one hand and the clamp bolt on the other, during establishment and release of a clamping position, and wherein further an actuating lever capable of being moved by a spring assembly into a position corresponding to the clamped position, is provided, characterized in that the spring assembly consists of plate springs surrounding the clamp bolt, said spring assembly is supported between a thrust bearing of the clamp bolt on a first side and one of the parts to be adjusted with respect to each other and clamped against each other on a second side, thereby acting through said thrust bearing directly on the clamp bolt and displacing the latter into the clamping position, actuation of the lever moves the clamp bolt, by direct action through said thrust bearing, against the springs, from the clamping position into the release position.

2. Seating furniture according to claim 1, characterized in that the actuating lever acts on a further thrust bearing of the clamp bolt.

3. Seating furniture according to claim 2, characterized in that the clamp bolt is provided further with a pressure thrust bearing, which under spring action exerts pressure against the plates and against a wall channel section to be displaced against it, said pressure thrust bearing being located on a side of the plates located opposite to the channel section to be frictionally locked against it.

4. Seating furniture according to claim 2, wherein the lever is in the form of a transmission lever and its long lever arm is carrying an actuating handle, characterized in that a short lever arm is penetrated by the clamp bolt and that said further thrust bearing is abutting against the short lever arm, said further thrust bearing being fastened to a protruding end of the clamp bolt.

5. Seating furniture according to claim 4, characterized in that a support surface, extends from the long lever arm of the actuating lever to an edge constituting a pivoting point of the lever, said support surface adapted to rest against the wall channel section to be frictionally locked with the plates.

6. Seating furniture according to claim 5, characterized in that the edge forming the pivot of the lever is located adjacent to the side facing it of the clamp bolt.

7. Seating furniture according to claim 6, characterized in that the short lever arm engages the part to be frictionally locked together with the plates, thereby securing the lever against rotation around the clamp bolt.

* * * * *

UNITED STATES PATENT AND TRADEMARK OFFICE

CERTIFICATE OF CORRECTION

PATENT NO. : 4,392,686

DATED : July 12, 1983

INVENTOR(S) : HERBERT BEER

It is certified that error appears in the above-identified patent and that said Letters Patent is hereby corrected as shown below:

Column 4, line 36, insert "actuating" before lever;

Column 4, line 51, insert "actuating" before lever.

The complete name of the assignee should read:

Steifensand Sitzmobel-und
Tischfabrik, Inh., Friedrich
M. Steifensand

Signed and Sealed this

*Twenty-ninth* Day of *November 1983*

[SEAL]

*Attest:*

GERALD J. MOSSINGHOFF

*Attesting Officer*

*Commissioner of Patents and Trademarks*